US005277094A

United States Patent [19]

Spuler

[11] Patent Number: 5,277,094

[45] Date of Patent: Jan. 11, 1994

[54] DEVICE FOR INSERTING STRINGS

[75] Inventor: Rolf Spuler, Winterthur, Switzerland

[73] Assignee: Hoshino Gakki Co., Ltd., Japan

[21] Appl. No.: 803,496

[22] Filed: Dec. 4, 1991

[30] Foreign Application Priority Data

Feb. 21, 1991 [CH] Switzerland ..... 530/91

[51] Int. Cl.[5] ..... G10D 3/04

[52] U.S. Cl. ..... 84/298; 84/307; 84/313

[58] Field of Search ..... 84/298, 307, 313, 207, 84/297

[56] References Cited

U.S. PATENT DOCUMENTS

| | | | |
|---|---|---|---|
| 2,152,783 | 4/1939 | Beauchamp | 84/298 X |
| 2,972,923 | 2/1961 | Fender | 84/307 |
| 4,563,934 | 1/1986 | Keizer | 84/313 |
| 4,608,905 | 9/1986 | Takabayashi | 84/313 |
| 5,088,375 | 2/1992 | Saijo | 84/298 X |
| 5,140,884 | 8/1992 | Bowden | 84/297 R X |

*Primary Examiner*—Michael L. Gellner
*Assistant Examiner*—P. Stanzione
*Attorney, Agent, or Firm*—Ostrolenk, Faber, Gerb & Soffen

[57] ABSTRACT

A device for installing one end of a string on a string musical instrument. A track on the body of the instrument has a first depression for receiving the bridge of the instrument for that string. The bridge has a string raising saddle on it, which can be adjusted in height and can be adjusted parallel to the length of the string. The installed end of the string extends past the saddle to a slide supported in a second depression on the track. A bolt on the slide receives a nut supported at the track to adjust displacement of the slide between a position where the supported string is at highest pitch and a position to which the slide can shift for the string to be at lowest pitch. A pivotable eccentric lever has two cam surfaces on it at different distances from the pivot axis of the lever. The different high and low pitch levels of the string are established by the different pivot positions of the lever cooperating with the displacement slide. Displacement range is adjustable. The individual device of the invention and particularly its track is narrow enough that a respective device or track may be positioned on the instrument for each of the strings with the devices next to each other.

17 Claims, 3 Drawing Sheets

DEVICE FOR INSERTING STRINGS

BACKGROUND OF THE INVENTION

The present invention relates to a device employed for inserting strings at one end of a stringed instrument, especially a guitar.

Each string of a stringed instrument, especially a guitar, has one end which is usually secured to the side of the head or peg head by a tuning mechanism and has another end which is inserted into a holding notch toward the end of the instrument body away from the head. Between its two ends, the string extends over the saddle of a bridge. The bridge lifts the string off the fingerboard and transmits its vibrations to a resonator, especially a sounding board. The tension on each string is adjusted with the tuning mechanism to tune the instrument before it is played.

Bridge-saddle units that can be adjusted in height and in their position along the instrument body have been developed which enable varying the height distance between the fingerboard and the strings and ensure proper acoustic equalization meaning octaval purity. Such components are usually mounted on a common base. Also known are combination mechanisms that involve a string holder. That end of each string on which there is a securing ball is inserted into the holder. Such devices are generally intended to accommodate several strings. Any need for more strings than the traditional number can only be accommodated with specially constructed devices of the type. Another drawback to such devices is that the adjustable bridges are unstable. As a result, the vibrations, especially of lightly tensioned strings, are accordingly suppressed and the strings change their sound.

Devices have been developed that enable tuning the strings with a tuning mechanism before the instrument is played and also that enable temporarily and rapidly varying the string pitch while the instrument is being played. These devices vary the tension of the string over a prescribed range for varying its pitch. Examples include pedal operated guitars, as shown in U.S. Pat. No. 4,106,387. A lever and rod make it possible to vary the pitch of a string or strings while the instrument is being played by adjusting the ensemble of the bridge and the string holder to attain what is called a Hawaiian effect. A device that operates on a similar principle with electric guitars is known from U.S. Pat. No. 4,354,417, for example.

U.S. Pat. No. 4,191,086 and German Patent 3 626 168 describe devices for varying the pitch of strings between two definite thresholds, specifically by way of a tuning mechanism mounted on the head of the instrument. German Patent 3 843 533, on the other hand, describes a device that can simultaneously tune and vary the pitch of several strings and that is mounted in the vicinity of the bridge. The major drawbacks to these devices are that they are mechanically complicated and accordingly expensive to manufacture, that they are not universally applicable, and that stable pitches cannot be ensured within the given range.

SUMMARY OF THE INVENTION

It is an object of the present invention to provide a device that performs the functions of string insertion, equalization, and varying of the string pitch between two prescribed thresholds. The device is intended to be universally applicable for stringed instruments of varying design and with any number of strings. It is intended to be inherently rigid enough and rigidly enough attached to the instrument to have no negative effect on the vibration of the strings. It should be possible to vary the pitch of each string by itself with simple manual controls and to replace strings without complicated manipulations. The device is intended to be strong and inexpensive to manufacture.

The device of the invention is intended for inserting, equalizing, and varying the pitch of only one musical instrument string, particularly a guitar string. Several identical ones of the devices can be positioned next to one another on the body of the instrument, for example the guitar, to perform the same functions for any desired number of strings. This approach allows universal application to any stringed instrument with any number and any placement of its strings. The end of the string on which the ball is positioned is inserted in the device. The other end of the string is secured at the conventional tuning mechanism, e.g. a respective peg on a guitar head. The string is conventionally fine tuned with the tuning mechanism of the musical instrument.

The device means comprises in the form of a track fixed on the body of the instrument, which includes a first depression for receiving the bridge of the instrument for that string. The bridge has a string raising saddle on it, and the bridge with its saddle on it is adjustable in the depression of the track along a path parallel to the string and also is adjusted in height and can be rigidly secured in any position to the track. The purpose of this part of the device is to equalize the strings and, due to its rigid connections, to ensure optimum resonance.

The installed, ball carrying end of the string extends past the saddle and is secured to a slide that is supported in a second depression in the track. The ball is held by a notch in the slide. The slide can be displaced along a path parallel to the string by an eccentric lever. This displacement varies the tension on the string and hence varies its pitch. The device also has means for confining the displacement of the slide within variable limits along the track. Two positions of the slide are accordingly precisely defined mechanically, providing the particular pitch of the string with high stability. A bolt on the slide is received in a nut supported at the track to adjust the displacement of the slide along the track between a position where the supported string is at the highest permitted pitch and a position to which the slide can shift for the string to be at lowest permitted pitch.

A pivotable lever is pivotably supported on the track. The lever has two surfaces defined around its pivotable end part, which are different respective distances from the pivot axis of the lever. One surface is a cam surface which is at a greater distance from the pivot axis, and when it engages the slide, it displaces the slide to the position which achieves the highest permitted pitch level of the string. The second surface is at a shorter distance from the pivot axis of the lever and this permits the slide to displace under the tension of the string to its position of lowest permitted pitch. The two surfaces are effective at two different pivot positions of the lever. In one version, the second surface is also a cam surface which engages the slide to position it. In another version, the second surface is spaced from the slide and the position of lowest string pitch is set by the above described bolt on the slide which is held to the nut at the track.

The individual device of the invention, and particularly its track, is narrow enough that a respective device or track may be positioned on the instrument for each of the strings and the devices and tracks are next to each other.

Other features and advantages of the present invention will become apparent from the following description of the invention which refers to the accompanying drawings.

BRIEF DESCRIPTION OF THE DRAWINGS

FIGS. *2a* and *2b* are sections through the device illustrated in FIG. 1, showing the eccentric lever and string holding slide in two different positions, to illustrate how the pitch of a string is varied and how both pitch thresholds are established.

DESCRIPTION OF THE PREFERRED EMBODIMENT

Figure 1:
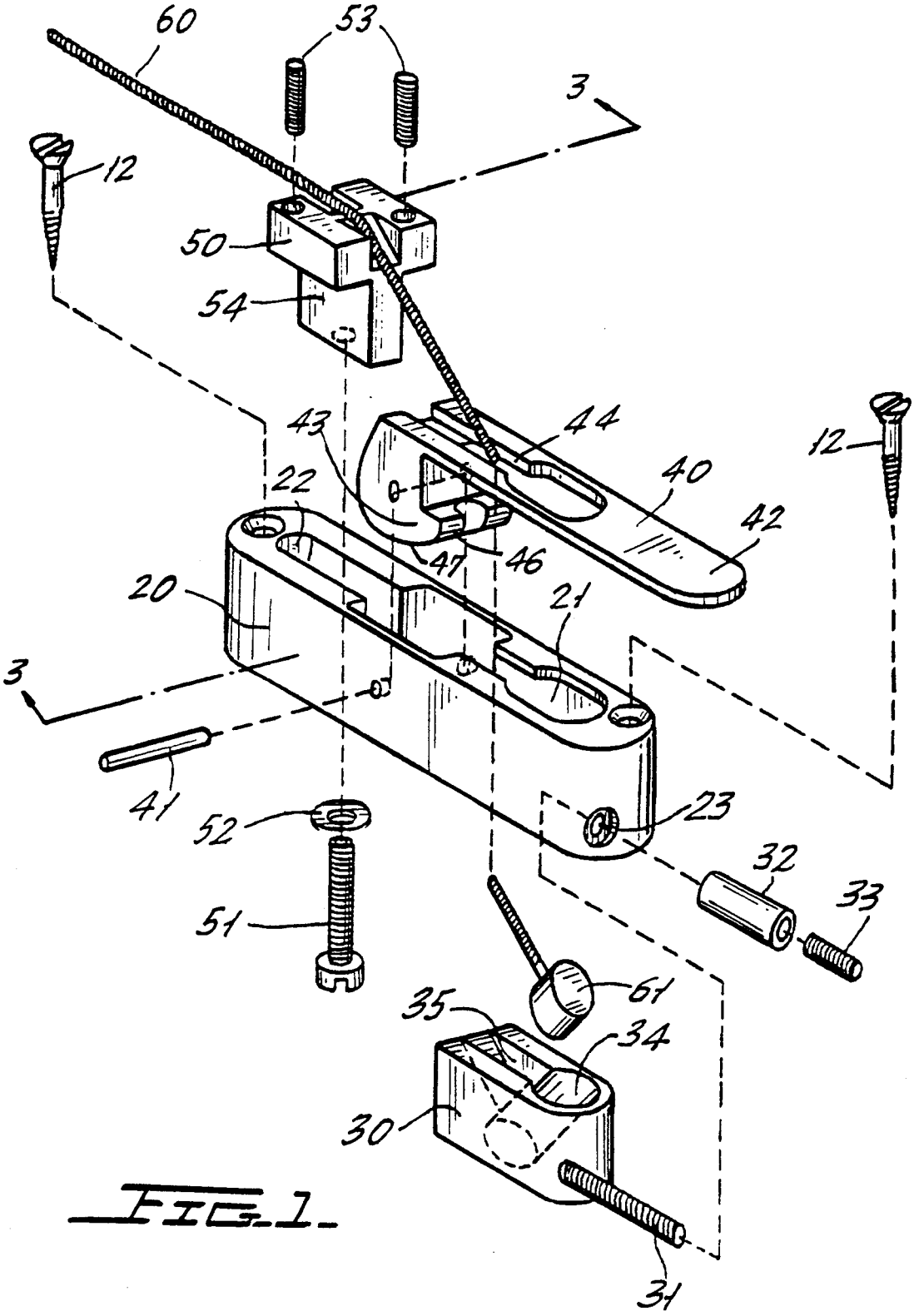
FIG. 1 is an exploded view of one embodiment of the device in accordance with the invention.

FIG. 1 is an exploded view of the individual components of one embodiment of the device of the invention. The major components are a track 20, a string securing and tensioning slide 30 in the track, an eccentric pivot lever 40 for adjusting the position of the slide along the track, and a bridge 50 also adjustably supported in the track.

The track 20 is rigidly attached to a musical instrument (not shown) with fasteners, like screws 12 for example. The track can alternatively be cemented to the instrument. The track has essentially two depressions, the rearward depression or slot 21 for accommodating the slide 30 and the forward depression or slot 22 for accommodating the bridge 50. Since the track is narrow in width and is positioned with its long dimension parallel to the string, several tracks, each for a respective string, can be mounted adjacent one another on the body of the instrument. Adjacent tracks are employed for adjacent string and are placed for maintaining the conventional lateral distances apart of the strings of the instrument. The track 20 is mounted on the instrument with the depression 22 for the bridge 50 oriented toward the fingerboard.

The slide 30 can be moved back and forth in the depression 21 in the track 20 along the direction of the string. The slide has a hole 34 that extends part way through it from the top and has a slot 35 next to the hole. The hole and slot secure the ball end 61 of a string 60 of the instrument in a usual manner, where the ball is locked in to the hole 34 by the narrowed slot 35 through which the string passes. Either or both of the slide 30 and the track 20 has means for confining the displacement of the slide within variable limits in relation to the depression 22 in the track that accommodates the bridge 50. These means comprise, for example, a threaded bolt 31 attached to the slide and extending through a hole 23 in the closed rear end of the track 20 and a knurled nut 32 screwed onto the bolt and sized to be held at the outside of the track. The nearer that the nut 32 is tightened to the slide 30, the less space that the slide has to travel back and forth in the depression 21. The rearward position of the slide is always set by its contact with the track at the rear of the depression. But the forward position is adjustably set by the nut outside bolt 31. The nut 32 can be locked into position on the threaded bolt 31 with a counter screw 33.

Figure 2A:
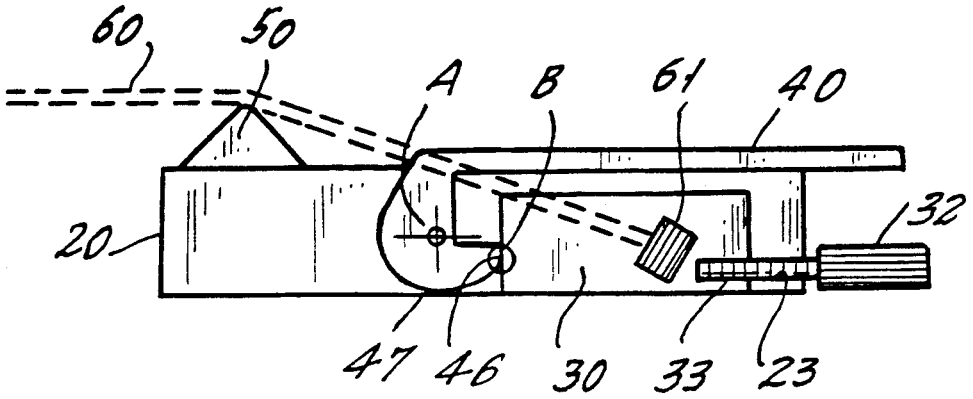
Figure 2B:
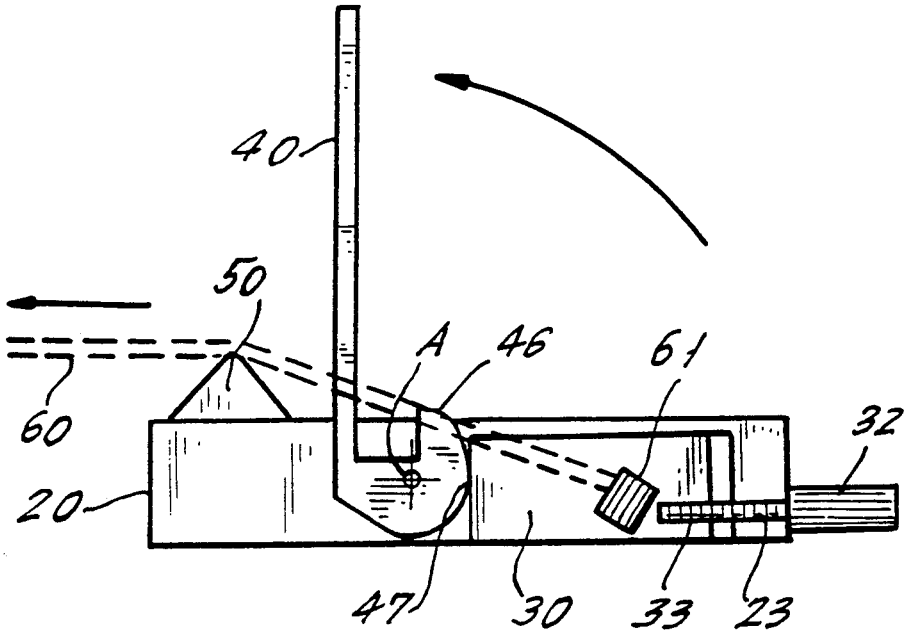

The rearward depression 21 that accommodates the slide 30 also accommodates an eccentric pivot lever 40. The lever 40 includes a pivot mounted end 43 that pivots on a shaft 41 which is held on the track 20. The lever has a free graspable end 42 which rests above the track 20. The pivot mounted end 43 of the eccentric lever 40 has two surfaces 46 and 47, at least one of which is a cam surface, formed at different circumferential locations around the shaft 41. The surfaces 46 and 47 are related to the shaft 41 such that, when the lever 40 pivots, it displaces the slide 30 parallel to the respective guitar string. The shape of the free end 42 of the eccentric lever 40 prevents the lever from coming into contact with the string 60 at any angle of lever pivoting. This is assured by a slot-like opening 44 through which the string extends from the slide 30 to the bridge 50. The function of the slide 30 and of the eccentric lever 40 are described below with reference to FIGS. 2(*a*) and 2(*b*).

A bridge 50 is accommodated in the forward depression 22 in the track 20. The bridge has a saddle on its top over which the string 60 passes. The depression 22 is shaped to allow the position of the foot 54 of the bridge 50 to be varied along a path parallel to the string and with respect to the height of the saddle above the track 20. The depression keeps the foot 54 within narrow limits laterally. Either the bridge 50 or the track 20 has means which enable varying the position of the bridge along the depression 22 and which secure the bridge to the track. These means may comprise displacement and securing screws 53 and 51. The adjustability of the bridge 50 in relation to the track 20 is described below with reference to FIG. 3.

FIGS. *2a* and *2b* illustrate the slide 30 and the eccentric pivot lever 40 in its two positions, which select the different pitch levels of a respective string. The free end 42 of the eccentric lever 40 rests against the track 20 in FIG. *2a*. In the illustrated embodiment, one or the other of the cam surfaces 46 and 47 defined on the common peripheral surface of the pivot mounted end 43 push the slide 30 against the force of the tensioned string 60. When the eccentric lever 40 is in the position of FIG. *2a*, the cam surface 46, which is further from the axis A, along shaft 41, rests against the slide. This holds the slide furthest rearward in the rearward depression 21 in the track and the string is tuned to its highest pitch.

When the free end 42 of the eccentric lever 40 is pivoted up against the bridge 50, as in FIG. *2b*, the slide 30 is moved forward against the cam surface 47, which is nearer to the axis A, by the force of the tensioned string 60. When the eccentric lever 40 and the slide 30 are in this position, the string is tuned to its lowest pitch. However, the forward position of the slide 30 need not be set by the surface 47. This is because in some cases, the slide is not able to move forward against the surface 47. Instead, the forward position of the slide is set by the tightened position of the nut 32 on the bolt 31. An embodiment without means 31, 32, 33 or confining the displacement of the slide 30 within variable limits is conceivable. In that case, the displacement of the slide 30 is limited only by the two cam surfaces 46 and 47 on the pivot mounted end 43 when eccentric lever 40 pivots.

The eccentric lever 40 is designed so that it cannot leave the position illustrated in FIG. *2a* without application of external force. It cannot pivot clockwise because its free end 42 rests against the top of the track 20. The cross-section of the pivot mounted end 43 that acts in conjunction with the slide 30 is a quarter of an ellipse. The pivot axis A is not on the midline of the ellipse. In the position illustrated in FIG. 2*a*, accordingly, the theoretical point B of eccentricity is not on the same height level on the slide 30 as the axis A of the lever. As a result, the eccentric lever 40 will be locked into the position illustrated in FIG. 2*a* by the force of the tensioned string such that the lever cannot pivot counterclockwise until it has been pivoted by an external force, like the players' hand.

The string highest pitch is fine tuned by the tuning mechanism on the instrument head (not shown), and the string lowest pitch is established relative to the highest pitch by confining the displacement of the slide within variable limits.

In most cases, when the eccentric lever 40 is in the upraised position (FIG. 2*b*), since the slide 30 is secured in the forward position by the means 31, 32, and 33 that confine its displacement within variable limits, the lever 40 is not maintained in the upraised position by the force of the tensioned string. To ensure that the lever will remain stable in this upraised position and that it will cause no parasitic noise, means of suppressing vibration in the form of an elastically deformable structure, a spring for example, can be interposed between the pivot mounted end 43 of the eccentric lever 40 and the depression 22 that accommodates the bridge 50.

Figure 3:
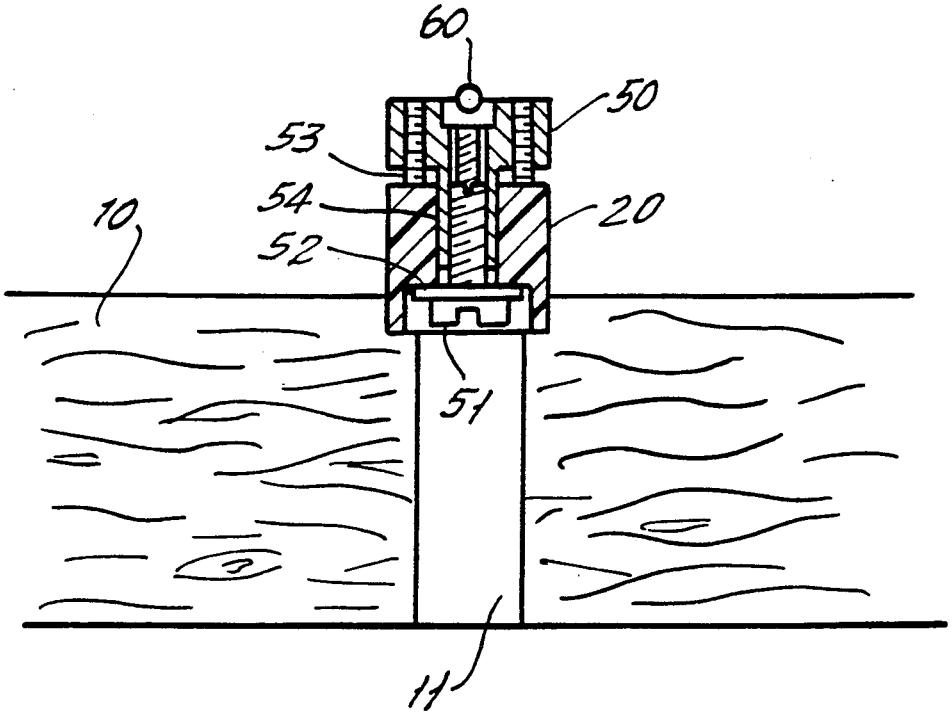
FIG. 3 is a section through the device illustrated in FIG. 1, taken perpendicular to the strings, to illustrate equalization.

FIG. 3 is a section perpendicular to the length (along line A—A in FIG. 1) of the strings through a device in accordance with the invention in the vicinity of the bridge 50. It illustrates one version of the means of securing and adjusting the position of the bridge 50 relative to the track 20. This embodiment requires a perforation 11 from the bottom of the instrument. The height of the saddle above the track 20 and hence the space between the string 60 and the fingerboard beneath the string is established by a displacement screw 53 while another screw 51 is loosened. The position of the bridge 50 parallel to the strings is adjusted and then secured by the tightening screw 51, which screws into the bottom of the foot 54 of the bridge 50. When the screw 51 is tightened, it forces a disk 52 against the track 20, rigidly connecting the bridge 50 and the track 20.

Some musical instruments cannot accommodate a perforation 11, at least in a position where it will be accessible from the rear of a device in accordance with the invention. In this event, the device can have a screw with a slot or an inside hexagon at its end and extending through a threaded bore in the bridge 50 from the saddle side.

Although the present invention has been described in relation to particular embodiments thereof, other variations and modifications and other uses will become apparent to those skilled in the art. It is preferred, therefore, that the present invention be limited not by the specific disclosure herein, but only by the appended claims.

What is claimed is:

1. A device for installing a string on a string musical instrument and for adjusting the pitch of the string between two values, the device comprising:

a bridge attachable to the instrument, the bridge including a saddle over which the string passes;

a slide displaceably supported on the instrument for displacement along the length of the string on the instrument, means on the slide for holding a respective end of the string, the slide and the bridge being so placed that the string extends from the slide past the saddle on the bridge to another location on the instrument;

slide position adjusting means supported on the instrument and engageable with the slide along the instrument, opposing the bias that is applied to the slide by the string extending from the slide over the bridge, the slide position adjusting means having a first position which displaces the slide to tension the string for a higher pitch and having a second position which enables the slide to be displaced to tension the string for a lower pitch, the slide position adjusting means comprising a lever supported at a pivot axis on the instrument, which pivots between the first and second positions with respect to the instrument, the lever having first and second cam surfaces, wherein when the lever is in the first position, the first cam surface engages and displaces the slide to the position of higher string pitch, and when the lever is in the second position the second cam surface faces toward the displaceable slide, and the slide is displaceable toward the second cam surface under the tension of the string to adjust the pitch of the string to a lower pitch.

2. The device of claim 1, wherein the first cam surface is located at a greater distance from the pivot axis than the second cam surface.

3. The device of claim 1, wherein the lever has a common surface thereon on which the first and second surfaces are defined, and the common surface is in the shape of an approximate quarter of an ellipse, with one side of the ellipse quarter being the first surface and another side of the ellipse quarter being the second surface, said first surface being further from the pivot axis of the lever than said second surface.

4. The device of claim 1, further comprising additional means, separate from the lever, for establishing the maximum extent of displacement of the slide in the direction toward the lower pitch of the string, when the slide displaces to engage the second surface, whereby the lower pitch level of the string is established by the additional means.

5. The device of claim 4, wherein the additional means comprises a threaded bolt attached to the slide and extending away from the direction of extension of the string, a nut tightenable onto the bolt, and means supporting the nut in position on the instrument, such that tightening of the nut on the bolt adjusts the maximum displacement of the slide with respect to the instrument under the tension of the string.

6. The device of claim 5, further comprising a track which is rigidly secured to the instrument, the slide being supported in the track, and the track having a depression for permitting the sliding displacement of the slide with respect to the track; the means for holding the nut in position with respect to the instrument comprises the track at which the nut is held.

7. The device of claim 1, further comprising a track which is rigidly secured to the instrument, the slide being supported in the track, and the track having a depression for permitting the sliding displacement of the slide with respect to the track.

8. The device of claim 7, wherein the bridge is also supported in the track.

9. The device of claim 8, further comprising means securing the bridge to the track for permitting adjustment of the height of the bridge and the saddle over the instrument and adjustment of the position of the bridge along the track.

10. The device of claim 9, wherein the means securing the bridge to the track comprises a screw between the bridge and the track, the screw being adjustable, and means in the track providing access to the screw at the bridge.

11. The device of claim 8, further comprising vibration suppressing means between the pivot mounted end of the lever and the portion of the track supporting the bridge.

12. The device of claim 8, further comprising the track being sufficiently narrow as to enable a plurality of the tracks to be positioned adjacent one another, each track receiving a respective slide for receiving a respective string.

13. The device of claim 1, wherein the device is sufficiently narrow as to enable a plurality of the devices to be positioned adjacent one another each for receiving a respective string.

14. A device for installing a string on a stringed musical instrument and for adjusting the pitch of the string between two values, the device comprising:

a bridge attachable to the instrument, the bridge including a saddle over which the string passes;

a slide displaceably supported on the instrument for displacement along the length of the string on the instrument, means on the slide for holding a respective end of the string, the slide and the bridge being so placed that the string extends from the slide past the saddle on the bridge to another location on the instrument;

slide position adjusting means supported on the instrument and engageable with the slide along the instrument opposing the bias that is applied to the slide by the string extending from the slide over the bridge, the slide position adjusting means having a first position which displaces the slide to tension the string for a higher pitch, and a second position which enables the slide to tension the string for a lower pitch, the slide position adjusting means comprising a lever supported at a pivot axis of the instrument to pivot between the first and second positions, extending from the pivot axis in the direction away from the bridge, and the lever has an opening through which the string extends from the slide through the lever toward the bridge, the lever including first and second cam surfaces, wherein when the lever is in the first position, the first cam surface engages and displaces the slide to the position of higher string pitch, and when the lever is in the second position the second cam surface faces toward the displaceable slide, and the slide is displaceable toward the second cam surface under the tension of the string to adjust the pitch of the string to a lower pitch.

15. A device for installing a string on a stringed musical instrument and for adjusting the pitch of the string between two values, the device comprising:

a track rigidly secured to the instrument;

a bridge movably disposed within the track, the bridge including a saddle over which the string passes;

a slide displaceably supported in the track for displacement along the length of the string on the instrument, means on the slide for holding a respective end of the string, the slide and the bridge being so placed that the string extends from the slide past the saddle on the bridge to another location on the instrument; and slide position adjusting means supported in the track and engageable with the slide along the instrument opposing the bias that is applied to the slide by the string extending from the slide over the bridge, the slide position adjusting means having a first position which displaces the slide to tension the string for higher pitch and having a second position which enables the slide to be displaced to tension the string for a lower pitch.

16. The device of claim 15, wherein the slide position adjusting means comprises a lever supported at a pivot axis on the instrument, the lever extending away from the bridge, to pivot between the first and second positions, the lever including first and second cam surfaces, wherein when the lever is in the first position, the first cam surface engages and displaces the slide to adjust the pitch of the string to a higher pitch, and when the lever is in the second position, the second cam surface faces toward the displaceable slide, and the slide is displaceable toward the second surface under the tension of the string to adjust the pitch of the string to a lower pitch.

17. The device of claim 15, wherein the first cam surface is located at a greater distance from the pivot axis than the second cam surface.

* * * * *